United States Patent [19]

Wernicki

[11] Patent Number: 4,727,720

[45] Date of Patent: Mar. 1, 1988

[54] COMBINATION ICE MOLD AND ICE EXTRACTOR

[76] Inventor: Paul F. Wernicki, 4501 NE. 21 Ave., #308, Fort Lauderdale, Fla. 33308

[21] Appl. No.: 854,145

[22] Filed: Apr. 21, 1986

[51] Int. Cl.[4] ..... R25B 21/02

[52] U.S. Cl. ..... 62/3; 62/353

[58] Field of Search ..... 62/3, 71, 353, 66, 340

[56] References Cited

U.S. PATENT DOCUMENTS

| | | | |
|---|---|---|---|
| 3,029,609 | 4/1962 | Zearfoss, Jr. | 62/353 X |
| 3,283,526 | 11/1966 | LeBoneff | 62/353 X |
| 3,418,823 | 12/1968 | Vivai | 62/353 X |
| 3,526,100 | 9/1970 | Briel | 62/340 X |
| 3,892,105 | 7/1975 | Bernard | 62/353 |
| 4,587,810 | 5/1986 | Fletcher | 62/340 X |

*Primary Examiner*—William E. Tapolcai
*Attorney, Agent, or Firm*—Charles L. Lovercheck; Wayne L. Lovercheck; Dale R. Lovercheck

[57] ABSTRACT

An ice maker is disclosed for freezing ice pieces and delivering the ice pieces to a receptacle under a chute. The ice machine is made up of an ice mold with an opening in its bottom which receives and ice extractor with an open bottom and upwardly and outwardly extending sides. An evaporator plate is supported below the opening in the ice mold bottom and a water supply is provided to maintain the water in the mold at a predetermined level. A thermo electro unit is disposed below the evaporator. Classical freon refrigeration can also be used. Thus when water is frozen to ice in the extractor, the refrigeration, or thermo-electric means melts the ice loose from the evaporator, in some models, and also from the ice extractor. The ice extractor, which is attached to a motor by means of an arm, swings to an inverted position over an ice chute from which the ice falls, is in some models aided by ambient heat, into a repository. The extractor then swings back into the mold for another cycle.

25 Claims, 4 Drawing Figures

COMBINATION ICE MOLD AND ICE EXTRACTOR

REFERENCE TO PRIOR ART

Prior art ice machines having trays that swing from an upright position for freezing ice to an inverted position have been known in the art. Examples of such machines are shown in U.S. Pat. No. 3,648,964 to Fox, U.S. Pat. No. 3,254,505 to DeTurk, and U.S. Pat. No. 3,892,105 to Bernard. These machines all freeze ice in the ice cube tray and invert the tray to discharge it. These machines are inefficient in operation, complex in structure, subject to malfunction and unreliable.

ADVANTAGES OF THE INVENTION

No mechanical parts are associated with the evaporator plate 17, the condenser or the thermo-electric module 11 disclosed herein. Heat sink compound (silicon or epoxy), is used to mount the evaporator to thermo-electric module and thermo-electric module to heat sink (or condenser). Because of the open bottom extractor 15, heat transfer is of optimum efficiency, that is, directly from the ice in the extractor to the evaporator 17 and thermo-electric module 11 which are mounted on the heat sink by silicon or epoxy type heat sink materials. Prior machines used film of material on an air gap between moving members. No stress is required to harvest or extract ice from the evaporator 17. Distortion of the evaporator 17 or extractor 15 is not required to harvest ice. The inherent inefficiency of the machine prevents the ice from sticking hard to the extractor 15; that is, heat flowing in from around the end and top of the ice extractor 15 keep ice from freezing hard to the extractor 15. The extractor 15 will be made from either brass, bronze or stainless steel to take advantage of the inherent thermal inefficiency of the machine. That is, the heat conducting quality of metal uses the inefficiency to keep ice from freezing hard to extractor 15. The lip 35 on the ice mold 13 is used to reduce heat transfer from the extractor 15 to the evaporator 17 to enhance the inherent inefficiency, which prevents ice from sticking to the extractor 15. The lip 35 may be molded into the plastic mold form 13 or it may be a piece of, say, silicon gasket between the plastic mold form and evaporator 17 to provide virtually a perfect seal. The extractor 15 has a sharp edge 32 which contacts the ice mold lip 35 or gasket to prevent ice from forming around the edge of the extractor 15 thus preventing the ice cube from hanging up during harvest. The sharp edge 32 firmly (positively) seals against the plastic of lips 35 and will seal against the bottom of the ice mold. The sharp edge comes into intimate contact with the lip 35 of the ice mold, due to the force of the stalled extractor motor 18. The motor 18 is stalled when the extractor is in the ice mold for two reasons: (1) To act as a force for the above and (2) to simplify design to eliminate the need for limit switches or position sensing switches. Several improved features of Applicant's ice maker are: (1) no lubricating film is required between the evaporator and the heat sink; (2) no large motor is required to create distortion (twisting) of the evaporator to harvest the ice; (3) rotary motion of the evaporator is not required; (4) the evaporator in this machine is flat and stationary; and, (5) no moving parts are needed in the evaporator or condenser; it is of solid state construction. Items 1 through 4 above would apply if the design were used with typical refrigerant systems using freon and compressors, or expanding gasses.

The dual wall 13, made up of walls 13' and 13'' of the ice mold is designed to give thermopane type insulation to limit inefficiency to practical levels (desirable levels). There are two such dual wall insulators which are the top wall insulator which prevents excessive heat from warming the water from the ambient air and the lower wall insulator 113, with adjacent space, which reduces heat from entering the evaporator from the aluminum heat sink type condenser. The location of the mounting holes in conjunction with the offset 38 of the lower dual wall insulators forms an inherent plastic spring to hold down the evaporator thermo-electric module 11, provide constant force between evaporator and thermo-electric module 11 to condenser to maximize heat transfer and efficiency, and provide water and air tight seal to prevent contamination and/or corrosion of thermo-electric module, evaporator and condenser.

STATEMENT OF THE INVENTION

Applicant has provided a combination ice mold and ice extractor efficient in operation, simple in construction and reliable. The ice in Applicant's machine is formed in a mold with tapered sides for easy extraction from a molded plastic device which can also have the feature of molding any specific shape that is, for example, initials, corporate logos, or shapes like animals or the state of Texas, and the like, all of which are referred to as things. The device extracts the ice from the ice mold by rotating it and dropping the ice into an ice container or bin. The ice mold extractor is actuated by a motor driven cam or reversible motor controlled by either an electronic or mechanical timer. Ice is formed in the ice mold-extractor on top of a flat thermoelectric freezer module and after a predetermined period of time, a defrost cycle is initiated in which the ice is melted from the thermoelectric module or evaporator and the ice mold extractor 15 rotates and removes the ice from the ice maker section and dumps it into the ice storage bin through chute 16. The extractor rotates from 90° to 180° depending upon the design of the specific model and returns back to the initial position and the freezing cycle is re-initiated to form the next ice cube. Intricate shapes or logos may require no lip on mold such that defrosting or harvesting the ice from extractor is aided by heat from the defrost cycle.

The ice mold 13 has an open bottom closed by evaporator plate 17, as recited in original claim 21, which overlies the opening in the bottom of the ice mold forming an open topped container. The lip 35 of the ice mold 13 engages the evaporator plate 17 and forms substantially a perfect seal. The open bottomed ice extractor 15 fits into the opening in the bottom of the ice mold 13 in the freezing position and the water level in the ice mold 13 stands up over the top of the flange of the ice extractor. The water level of water in the ice mold is controlled by the float 23. Heat from the water in the ice extractor is absorbed by the evaporator plate 17 and the water in the ice extractor is therefore frozen from the bottom upwardly. Relatively warm water in the ice mold surrounds the ice extractor 15 and keeps the water of the extractor relatively warm. Therefore, ice does not freeze hard to the inside surface of the ice extractor walls and does not freeze to the outside of the ice extractor at all.

Moreover, the path for heat to flow from the evaporator plate 17 to the walls of the ice extractor is further reduced by the sharp edges 32 of the ice extractor, as shown in FIG. 2. This, coupled with the fact that the heat is supplied to the outside of the ice extractor by the warm water in the ice mold around the outside of the ice extractor, prevents ice from freezing to the ice extractor. Thus, the ice freezes in the ice extractor from the bottom upwardly as heat is carried away by the evaporator plate but does not freeze hard to the walls of the ice evaporator.

The harvest cycle is initiated when ice fills the extractor. When the ice harvest cycle is initiated, the electrical power to the electrothermo module 11 is turned off at control 30, and since the evaporator plate's temperature rises to water temperature, there is no longer a heat gradient and heat no longer continues to flow from the water in the ice extractor to the evaporator plate 17 and the ice is released from the evaporator plate. The motor 18 then swings the ice extractor from the position A through the position B to the position C. Heat from the ambient warm air then flows through the metal walls of the ice extractor 15 and melts loose any ice that may be adhering to the inside of the ice extractor and ice from the ice extractor then falls by gravity into the ice chute 16.

The ice extractor is preferably made up of a good thermo-conductor for example, aluminum, brass, bronze or stainless steel, to prevent the ice cube from freezing very hard to it. This is accomplished by the fact that the water surrounding the cube and extractor is warmer and not frozen and therefore allows heat to flow into the extractor preventing hard freezing of the cube to the extractor. This provides reliable and easy ice extraction and also dumping as ambient heat provides a slippery water film to develop during the harvest or defrost cycle to allow the ice to simply fall out of the extractor.

OBJECTS OF THE INVENTION

It is an object of the invention to provide an improved ice making machine for making a small number of cubes.

Another object of the invention is to provide an ice making machine that is simple in construction, economical to manufacture and simple and efficient to use.

Another object of the invention is to provide a combination ice molder and ice extractor. The ice is formed in a mold with tapered sides for easy extraction and the device extracts the ice from the ice maker by rotating it and dropping the ice into an ice container or bin. The ice is formed on a thermo-electric freezer module which forms the bottom of the ice mold.

With the above and other objects in view, the present invention consists of the combination and arrangement of parts hereinafter more fully described, illustrated in the accompanying drawing and more particularly pointed out in the appended claims, it being understood that changes may be made in the form, size, proportions, number of cubes and minor details of construction without departing from the spirit or sacrificing any of the advantages of the invention.

DETAILED DESCRIPTION OF THE DRAWINGS

Figure 1:
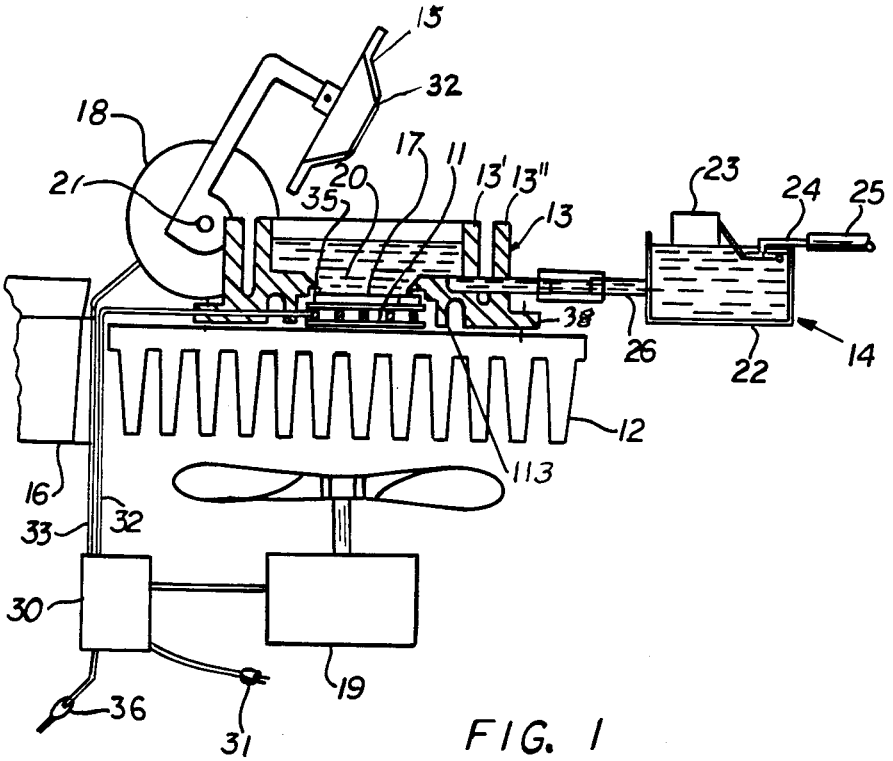
FIG. 1 is longitudinal cross sectional view of the machine.

Now with more particular reference to the drawings, I show a combination ice cube mold and extractor 10 comprising a thermo-electric module 11, a heat sink 12 supporting the module 11 and ice extractor 15 above the thermo-electric module 11. A water supply tank 14 is supported on the machine alongside of the ice mold 13 and float valve 24 controls the flow of water from a float tank 22. The water level in the float assembly tank 22 is maintained at the proper level to maintain a water level in the ice mold 13. This is accomplished by the float 23 which controls valve 24 from the supply line 25. The supply line 25 may be a water tap from a city main or the like or from gravity fed tank. The ice mold 13 has a cavity in its bottom and the evaporator 11 forms a closure for the opening. The float tank 22 is connected through the water line 26 to the space inside the ice mold 13 and the level of water in the tank is maintained equal to the level in the mold 13.

Figure 2:
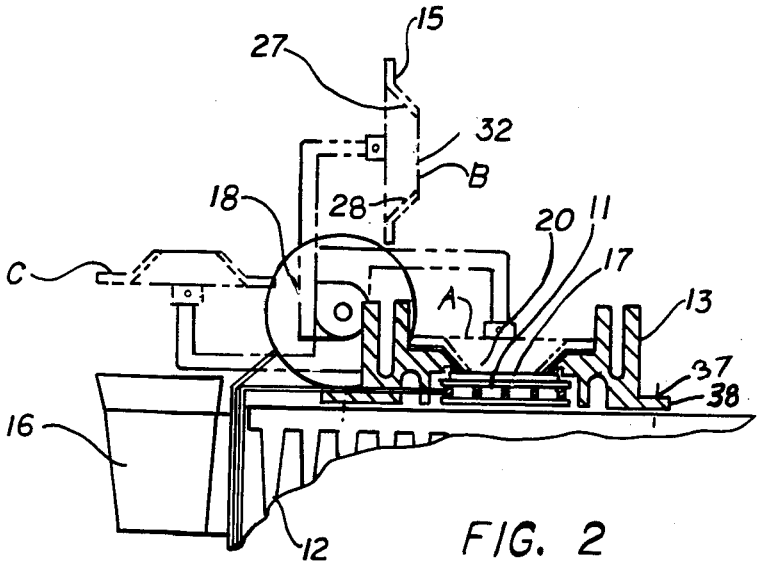
FIG. 2 is another longitudinal cross sectional view partial broken away showing the ice extractor in a position over the ice chute as shown in phantom lines in the ice cube mold and in further phantom line position in an intermediate position between the ice mold and the ice cube chute.
Figure 3:
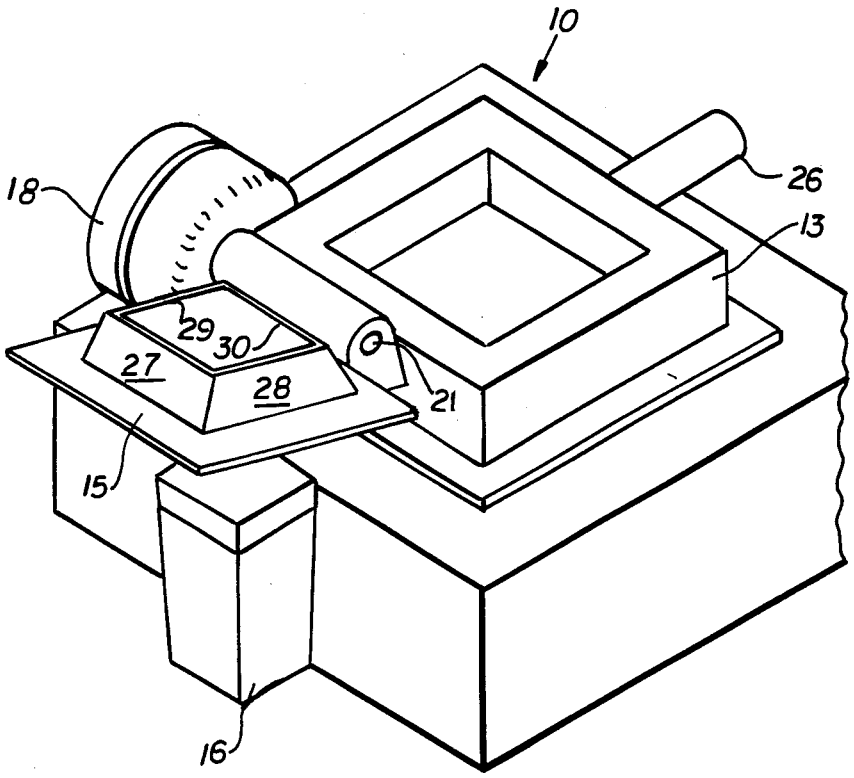
FIG. 3 is an isometric view of the ice cube machine according to the invention.
Figure 4:
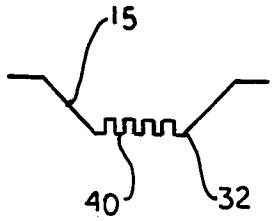
FIG. 4 is a sectional view of the ice extractor.

The ice extractor 15 is swingably connected to the shaft 21 of the motor 18. The motor 18 is a reversible motor which will swing the ice extractor 15 from the position A, shown in FIG. 2, through the position B, to the position C where it is inverted over the ice cube chute 16. In this position ice will fall from the mold. The ice extractor 15 has four downwardly and inwardly converging side walls 27, 28, 29 and 30 that terminate in a sharp edge 32 which engages the mold in the refrigeration means so that the ice cube will easily fall out of the extractor when it is in the position C, over the ice cube chute 16. Ambient heat melts the ice loose from the walls 27–30 of the ice mold. Walls 27–30 could be of a greater number of sides or intricately shaped for various other forms.

The evaporator plate 17 is supported over top of the thermo-electric module 11 and the evaporator plate 17 forms a bottom for the opening in the mold 13 and conducts heat from the water in the ice mold and extractor to the heat sink.

Ice cubes from the ice extractor 15, when it is in the C position, fall into the chute 16 and may drop from there into a suitable ice cube bin.

The condenser or heat sink 12 has suitable fins as shown thereon for carrying heat away from the module. The fan 19 circulates air over the fins of the heat sink 12 to remove heat from it.

The ice mold 13 has a downwardly facing shoulder 35 which rests on the outer periphery of evaporator plate 17. Ice mold 13 has an outwardly directed flange 38 which has mounting holes 37 which receive studs that extend into heat sink 12. The offset of mounting holes location in conjunction with the offset dual wall insulator prevents excessive heat transfer from the evaporator plate to the ice mold.

A suitable electrical control panel 30 connects electricity from twelve volts DC from plug 36. A plug 31 could also be provided to connect the control 30 optionally to a 120 volt AC circuit.

The ice maker disclosed herein has the following features and advantages over all prior art known to Applicant: (1) no moving parts are associated with the evaporator or condenser or thermo-electric module; (2) no lubricating film is used for both heat transfer and lubrication. Heat transfer is as efficient as possible, that is, directly from the ice; (3) no stress is required to harvest or extract ice from the evaporator. Distortion of the evaporator or extractor is not required to harvest ice; (4) the inherent inefficiency of the machine prevents the ice from sticking to the extractor; that is, heat flowing in from around end and top keeps ice from freezing hard to the extractor; (5) the extractor will be made from either brass or stainless steel to take advantage of the inherent inefficiency of the machine, that is, the heat conducting quality of metal is used to use inefficiency to keep ice from freezing hard to the evaporator; (6) the lip on the ice mold is to reduce heat transfer the extractor to the evaporator to enhance the inherent inefficiency, which prevents ice from sticking to the extractor. The lip may be molded in the plastic evaporator form or be a piece of, say, silicon gasket between the plastic form and evaporator to provide even better (perfect) seal; (7) the extractor is pointed on the edge which contacts and has latches which provide the spaced legs 40 the ice mold to prevent ice from forming around the edge of the extractor to prevent the ice cube from hanging up in harvest. The point more firmly (positively) seals against the plastic and would undoubtedly seal against the silicon gasket; and (8) the pointed edge comes into intimate contact (seated) on the lip of the ice mold, due to the force of the stalled extractor motor. The motor is stalled for two reasons: (1) to act as a force for the above and (2) to simplify design to eliminate the limit switches (position sensing switches).

Improvements over prior art ice makers are that no lubricating film is required, no large motor to create distortion (twisting) of the evaporator to harvest the ice, rotary motion of the evaporator is not required, the evaporator in this approach is flat and stationary and there are no moving parts in the evaporator or condenser. "solid state" electronics is used. Other claims to my invention are that the dual wall of the ice mold is designed to give thermopane type insulation to limit inefficiency to practical levels (desirable levels). There are two such dual wall insulators which are the top wall insulator which prevents excessive heat from warming the water from ambiant air and the lower wall insulator which reduces heat from entering the evaporator from the aluminum heat sink type condenser. The mounting holes location in conjunction with the offset dual wall insulators form an inherent plastic spring to hold down the evaporator thermo-electric module, provide constant force between evaporator and thermoelectric module to condenser to maximize heat transfer and efficiency, and provide water and air tight seal to prevent contamination and/or corrosion of thermoelectric module, evaporator and condenser.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination an ice mold having an open top, a bottom and a cavity in said bottom, means to supply water to said open top mold and an ice receiving means, a hollow ice extractor having spaced sides, an open top and an open bottom, refrigeration means associated with said ice mold below said cavity in said bottom, means swingably supporting said ice extractor on said ice mold, said spaced sides being inclined from the lower edge of said extractor upwardly and outwardly when said extractor is in position in said ice mold, said ice extractor being adapted to receive water with said refrigeration means closing said open bottom of said ice extractor whereby ice is frozen in said ice extractor, said ice extractor being adapted to be swung out of said ice mold to an inverted position over said ice receiving means whereby ambient air engages said ice extractor, melting the ice that is in contact with said ice extractor and allowing said ice to fall from said extractor into said ice receiving means.

2. The combination recited in claim 1 wherein said ice extractor is made of a good heat conducting material, said ice extractor has sharp lower edges adapted to rest on said ice mold.

3. The combination recited in claim 1 wherein opening in said ice mold bottom receives said ice extractor, said refrigeration means being disposed under said opening in the bottom of said ice mold and forming a bottom for said cavity.

4. The combination recited in claim 1 wherein said means swingably supporting said ice extractor comprises an arm swingably supported with respect to said mold and said extractor is loosely attached to said arm, motor means connected to said arm to swing said arm and said extractor from a position in said ice mold to a position over said ice receiving means adjacent said ice mold.

5. The combination recited in claim 2 wherein said refrigeration means includes an evaporator plate.

6. The combination recited in claim 5 wherein said refrigerator means is a freon type refrigerator means.

7. The combination recited in claim 5 wherein said refrigerator means includes a compression expansion refrigerator means.

8. The combination recited in claim 5 wherein said refrigerator means includes an expansion type refrigerator means.

9. The combination recited in claim 5 wherein a thermo-electric module is disposed under said evaporator plate.

10. The combination recited in claim 3 wherein said ice mold is shaped to mold the ice in the shape of specific shapes.

11. The combination recited in claim 3 wherein said ice extractor has an outwardly directed flange and the bottom of said ice mold includes a bottom means disposed around said cavity and underlying said flange when said ice extractor is disposed in said ice mold.

12. The combination recited in claim 11 wherein a water supply means is provided for said ice mold for maintaining the water level in said mold at a predetermined level.

13. In combination an ice cube machine comprising:

an ice mold made of thermo-plastic material or other low thermally conductive moldable material, an evaporator plate, a water supply, an ice extractor, an ice extractor motor, a cavity in the bottom of the ice cube mold,
said ice extractor being received in said cavity in said mold,
said evaporator plate being disposed below said bottom of said ice cube mold,
connecting means connecting said water supply to said mold to maintain the water in said mold at a predetermined level,
swingable means swingably connecting said ice extractor to said ice extractor motor,
an ice chute,
means to move said ice extractor from a position in said ice mold to an inverted position over said ice cube chute, whereby an ice cube in said ice extractor will melt loose from said extractor and fall from said extractor into said chute.

14. The combination recited in claim 13 wherein said ice extractor has an outwardly directed flange adapted to overlie said ice mold bottom around said cavity.

15. The combination recited in claim 1 wherein said ice mold has dual wall sides and a square open top and a sharp lower edge of said ice mold disposed around the periphery of said cavity and engaging said evaporator plate providing a seal between said ice mold and said evaporator plate.

16. The combination recited in claim 2 wherein said ice extractor has side walls defining a generally square enclosure with open to and open bottom,
said ice extractor is adapted to be received in said opening in said ice mold with the bottom edges of said ice extractor sides resting on said refrigeration means.

17. The combination recited in claim 3 wherein said water supply comprises a float tank assembly,
said float tank assembly having a float control valve for controlling the level of water in said float tank equal to the level of water desired in said ice mold.

18. The combination recited in claim 4 wherein said swingable means supporting and ice mold extractor to said ice mold comprises an arm swingably attached to said ice mold and adapted to be swung from a position inside said ice mold to an inverted position over said ice cube chute.

19. The combination recited in claim 5 wherein said swingable means connected to said ice extractor comprises an ice extractor motor on said ice mold,
said motor having a shaft attached to an arm,
said arm being loosely attached to said ice extractor whereby the loose attachment allows for a firmer more positive seal of said mold lip or evaporator plate.

20. An ice machine comprising a mold,
an ice extractor,
an evaporator plate and a water supply,
said mold comprising sides, a bottom and an open top,
said bottom having a cavity therein defined by cavity sides terminating in an opening in the bottom,
said cavity sides are tapered downwardly and inwardly converging toward said opening terminating in sharp edges,
said evaporator plate being disposed below said opening,
sealing means between said ice mold and said evaporator plate whereby said evaporator plate forms a closure for said opening in said ice mold,
said ice extractor having an open top, an open bottom and sides extending downwardly and inwardly terminating in a sharp lower edge,
said extractor being adapted to be received in said cavity,
said sharp lower edge of said extractor resting on said evaporator plate,
means to supply water to said mold,
means to swing said ice extractor from a position in said cavity to an inverted position over an ice receptacle,
a heat sink,
said ice mold being supported on said heat sink,
said evaporator plate being supported in spaced relation to said heat sink.

21. The ice machine recited in claim 20 wherein said sharp edge engages said evaporator plate forming a seal between said mold and said evaporator plate.

22. The ice maker recited in claim 20 wherein said ice extractor has tapered sides and is adapted to swing over said receptacle in an inverted position whereby ice from said extractor may fall from said extractor when said extractor is inverted over said receptacle.

23. The ice making machine recited in claim 22 wherein said ice mold has outwardly directed flanges attached to the upper part of sides of said ice extractor,
said flanges overlying said ice mold bottom around said cavity when said ice extractor is supported in said opening in said ice mold bottom,
said ice mold and said flanges being made of high heat conductivity material whereby heat from the ambient atmosphere is conducted to said ice in said extractor to free ice in said extractor from adherence to said extractor.

24. The ice machine recited in claim 23 wherein said open bottom of said extractor has a shape to conform to an ice piece of a predetermined outline of a recognizable object.

25. The ice machine recited in claim 24 wherein said lower edges of said extractor are sharp.

* * * * *